US009913561B1

(12) United States Patent
Rodriguez

(10) Patent No.: US 9,913,561 B1
(45) Date of Patent: Mar. 13, 2018

(54) PORTABLE 2-IN-1 HAND CLEANSER

(71) Applicant: Perkin & Perkin LLC, New York, NY (US)

(72) Inventor: Jack Rodriguez, Bernardsville, NJ (US)

(73) Assignee: Perkin & Perkin LLC, New York, NY (US)

( * ) Notice: Subject to any disclaimer, the term of this patent is extended or adjusted under 35 U.S.C. 154(b) by 0 days.

(21) Appl. No.: 15/265,234

(22) Filed: Sep. 14, 2016

(51) Int. Cl.

| | |
|---|---|
| ***B67D 1/07*** | (2006.01) |
| ***A47K 5/12*** | (2006.01) |
| ***B08B 1/00*** | (2006.01) |
| ***A47K 10/32*** | (2006.01) |
| ***B05B 11/00*** | (2006.01) |

(52) U.S. Cl.
CPC ..... *A47K 5/1201* (2013.01); *A47K 5/1211* (2013.01); *A47K 10/32* (2013.01); *B05B 11/3052* (2013.01); *B05B 11/3059* (2013.01); *B08B 1/006* (2013.01); *A47K 2010/3233* (2013.01)

(58) Field of Classification Search
CPC .... A47K 5/1201; A47K 5/1211; A47K 10/23; A47K 2010/3222; B08B 1/006; B05B 11/3052; B05B 11/3059
USPC .... 222/192, 153.01, 153.03, 153.04, 153.13, 222/321.7–321.9, 325, 182–184
See application file for complete search history.

(56) References Cited

U.S. PATENT DOCUMENTS

| | | | | |
|---|---|---|---|---|
| 6,321,937 | B1 * | 11/2001 | DeSimone | A47K 10/3818 221/45 |
| 6,431,405 | B2 * | 8/2002 | Irwin | A47K 10/32 222/192 |
| 9,365,320 | B1 * | 6/2016 | Erickson | B65D 25/20 |
| 2008/0054018 | A1 * | 3/2008 | Stechschulte | A47K 5/1205 222/78 |
| 2009/0032553 | A1 * | 2/2009 | Eddy | A61L 9/12 222/192 |
| 2009/0302062 | A1 * | 12/2009 | Maddy | B05B 11/0054 222/183 |
| 2012/0298695 | A1 * | 11/2012 | Garrison | B05B 11/0037 222/175 |

* cited by examiner

*Primary Examiner* — Lien Ngo
(74) *Attorney, Agent, or Firm* — Parker Ibrahim & Berg LLC; Kenneth J. Heywood; Robert M. Amici

(57) ABSTRACT

A portable, hand-held device for dispensing both fluid hand sanitizer and dry wipes is described. In various embodiments, the portable hand sanitizer device has a lower assembly comprising a means for storing and dispensing dry wipes and a means for blocking actuation and dispensing of a fluid sanitizer, and the upper assembly comprises a means for dispensing fluid sanitizer and a means for engaging or not engaging the actuation block.

20 Claims, 6 Drawing Sheets

PORTABLE 2-IN-1 HAND CLEANSER

TECHNICAL FIELD

The present disclosure relates generally to devices for storing and dispensing hand sanitizers and, more particularly, to a portable, hand-held device for dispensing both fluid sanitizers and dry wipes.

BACKGROUND

Various types of devices for storing and dispensing sanitizers are known, and they are often designed for specific types of sanitizing means. For example, pumps or spray nozzles can be attached to containers of different sizes and shapes to enable delivery of fluid sanitizers, including liquid and gel-type sanitizers. In particular, alcohol-based gels can be squirted from a manual or automatic pump dispenser into a user's hands, which evaporate when the hands are rubbed together for cleaning. In addition, wipe or towel dispensers can be used to provide, for example, paper towels or cleanser-moistened wipes for hand cleaning, and hand wipe dispensers of various sizes and functions are common. The packaging is designed depending on the desired application. For example, for wet wipes, the dispenser must also ensure that the wipes do not dry out substantially over time.

Hand sanitizers, either fluid or wipes, are particularly useful when soap, water, and towels are not available. This most often occurs when a user is traveling, particularly with children. However, providing sanitizers in a compact, portable package for ready use is challenging. Liquid sanitizers can evaporate or spill when carried, for example, in a pocket or purse, and wet wipes can similarly become dried out and unusable. Furthermore, use of one type of sanitizer is often insufficient for the user's needs. For example, it is often desirable to have both a liquid sanitizer and a dry wipe available to more fully remove dirt and grime on one's hands. The need for storing and dispensing multiple types of sanitizers in one package is particularly challenging, especially in an easy to carry form. In addition, since single purpose containers must be disposed when empty, adding waste and cost, it would be particularly desirable for a multi-use dispenser to house multiple products in one.

As people become increasingly interested in preventing the spread of germs, there is a need for a sanitizer dispensing device that is portable and capable of storing and dispensing both a wet hand sanitizing fluid and a dry wipe or towel for thorough hand cleansing.

SUMMARY

The present disclosure relates to a hand sanitizer device that is portable and houses both sanitizing liquid and dry wipes. In various embodiments, the portable hand sanitizer device has an upper assembly and a lower assembly. The lower assembly comprises a base shell and a means for storing and dispensing dry wipes. The lower assembly further comprises a means for blocking actuation of a fluid sanitizer dispensing means positioned within the upper assembly. The upper assembly comprises an upper shell coupled to the base shell, the means for dispensing fluid sanitizer, and a means for engaging the actuation blocking means.

In one embodiment, the portable hand sanitizer device has a lower assembly comprising a base shell, a dispenser cradle coupled to the base shell forming a lower compartment configured for storing dry wipes, at least one pump actuation block, and at least one access configured for dispensing the dry wipes. The upper assembly comprises an upper shell coupled to the base shell and a fluid sanitizer dispenser positioned on the dispensing cradle of the base shell and within the upper shell. The dispenser comprises a pump for dispensing fluid sanitizer when depressed, with the pump removably coupled to a container to store fluid sanitizer, and a pump control contactable with the pump when depressed and rotatable to engage the pump actuation block.

Also disclosed is a method of dispensing fluid sanitizer and dry wipes using the disclosed portable hand sanitizer device. In one embodiment, the method comprises providing a portable hand sanitizer device described herein, filling the container with fluid sanitizer and the lower compartment with dry wipes, rotating the pump control, such as by rotating the upper shell relative to the base shell, to not engage the pump actuation block, dispensing fluid sanitizer by depressing the pump control to contact the pump inserted into the fluid sanitizer; and removing at least one dry wipe through the access in the base shell. These steps may be repeated until the fluid sanitizer, the dry wipes, or both are consumed, with the device replaced as needed.

It is to be understood that both the foregoing general description and the following detailed description are exemplary and explanatory only and are intended to provide further explanation of the present disclosure, as claimed.

BRIEF DESCRIPTION OF THE DRAWINGS

The foregoing and other objects, features, aspects, and advantages of the embodiments disclosed herein will become more apparent from the following detailed description when taken in conjunction with the following accompanying drawings.

Figure 1:
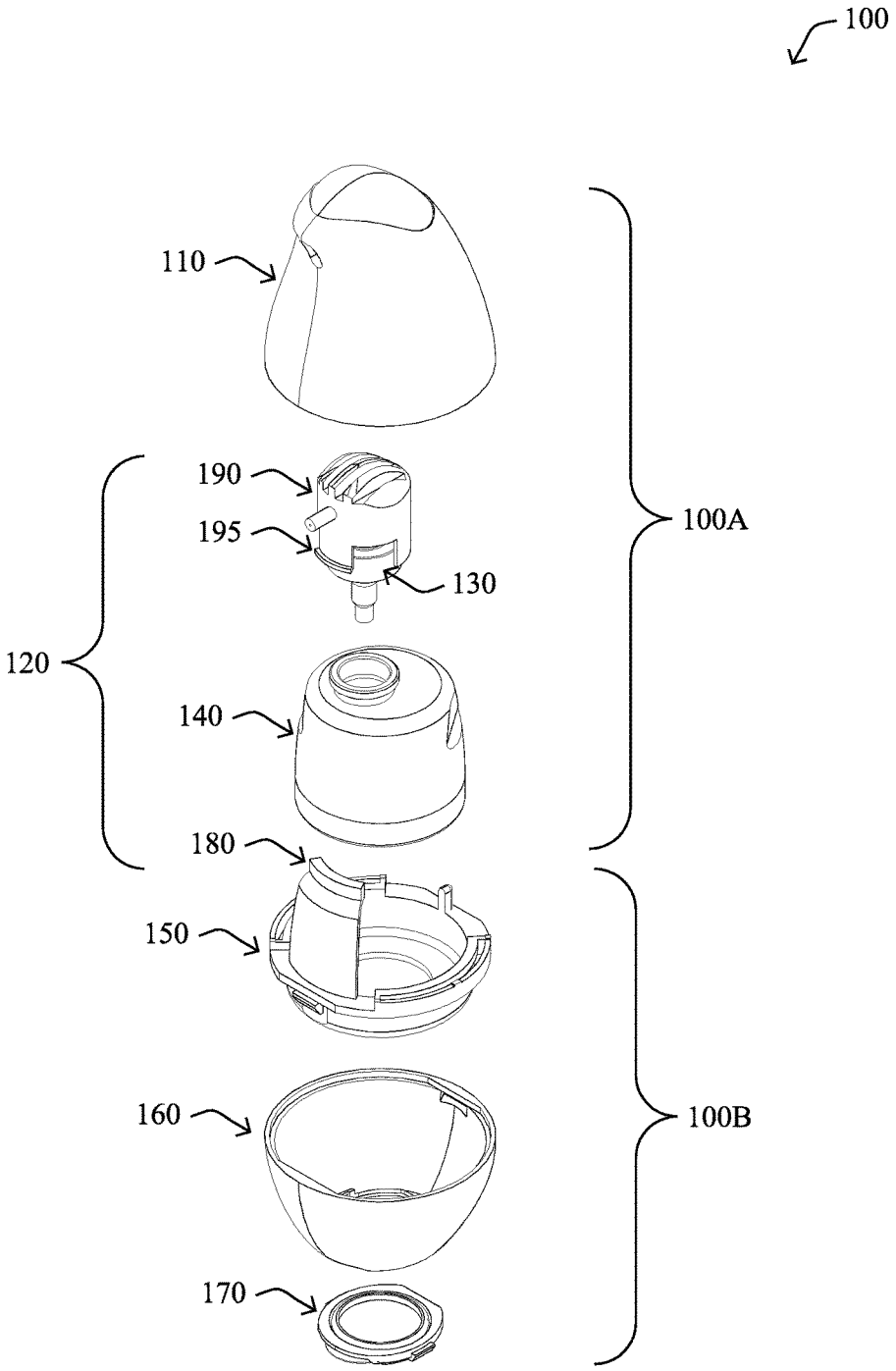
FIG. 1 is an exploded view of a specific embodiment of the portable hand sanitizer device of the present disclosure.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DESCRIPTION OF EXAMPLE EMBODIMENTS

The present disclosure describes a sanitizer device that is portable and can store and dispense both a fluid sanitizer and dry wipes as needed, for example, to clean a user's hands.

The sanitizer device of the present disclosure comprises an upper assembly and a lower assembly which are combined to form the device. The lower assembly comprises a base shell and a means for storing and dispensing wipes, and the upper assembly comprises an upper shell and a means for dispensing a fluid sanitizer. In one embodiment, the lower shell further comprise a means for blocking actuation of the fluid sanitizer dispensing means, thereby preventing accidental or inadvertent release of the fluid sanitizer. The upper shell may further comprise a means for engaging the actuation blocking means. The shells, when coupled to each other, form an outer housing for the device. Each shell can have any size, shape, and texture as desired for the intended application, including esthetics, ergonomics, and cost, and, when combined, create the overall geometry and design of the device. For example, the upper shell may have a round outer profile configured to conform comfortably with a user's hands, particularly as fluid sanitizer is dispensed. In addition, the base shell may have round or curved outer profile also to conform to a user's hand when held, and may particularly be substantially spherical in shape to accommodate stored wipes. The base shell may also have a flat section to allow the device to stand upright. A specific example is described in more detail below.

In one embodiment, the storage and dispensing means of the lower assembly of the device comprises at least one lower compartment configured for storing wipes, such as hand wipes. For example, the lower assembly may further comprise a dispenser cradle as a means for supporting a fluid sanitizer dispenser, and the cradle is coupled or otherwise attached, to the base shell, thereby forming the lower compartment. In addition, the lower assembly may further comprise at least one access or opening into the lower compartment and through which wipes can be dispensed. The access to the wipes can comprise a cover that can be removed and uncoupled from the access or may be a hinged cover. Alternatively, or in addition, the access may be a coverless access sized and shaped so that the wipes remain contained in the lower compartment but can be pulled through the access when needed. Such openings and designs will be known to one skilled in the art. In a specific embodiment, the access is on the bottom of the device and may further form a flat section upon which the portable hand sanitizer device can stand, resting upright.

The wipes can be of various types, particularly tissues or towelettes, cloth or paper, moist or dry, that are intended to be used for cleaning or removing dirt or unwanted substances from a person's hands. The wipes may be provided in any form, such as in a roll or in a stack, and, further, may either be connected one to another, such as by tearable perforations, or provided as individual separate units. If perforated groups of wipes are used, the base assembly optionally may further comprise a means for tearing or separating the wipes along the perforations.

The upper assembly of the portable hand sanitizer device may comprise at least one upper compartment in which the means for dispensing a fluid sanitizer is held and secured. The fluid sanitizer includes any known aqueous or alcohol-based liquid, dispersion, or gel-type hand sanitizer. For example, the upper compartment may be the area between the upper shell and the dispenser cradle of the lower assembly.

In a particular embodiment, the fluid sanitizer dispensing means is a dispenser comprising a container, such as a bottle or tub, in which the fluid sanitizer can be stored, and a pump insertable into the fluid sanitizer and removably coupled with the container. The pump can be any device which, when inserted into the sanitizer in the container and depressed, is capable of dispensing the fluid sanitizer, such as into a user's hand. The container can be any enclosure in which the fluid sanitizer can be safely stored. Preferably, the dispensing cradle comprises a section sized and shaped to fit the bottom of the container and into which the fluid sanitizer dispenser can be securely positioned.

The pump of the dispenser may further comprise a nozzle, which preferably protrudes through the side of the upper shell, particularly horizontally, enabling the pump to deliver and direct sanitizer either as a spray or as a pool or single shot, as appropriate for the type and viscosity of the fluid sanitizer. As such, in a specific embodiment of the present disclosure, the upper shell further comprises an opening through which the fluid sanitizer can be dispensed. The opening can be sized and shaped to accommodate movement of the nozzle when the pump control is depressed and released. Preferably, the opening is on the side of the shell, and the nozzle coupled to the pump protrudes through the opening substantially perpendicular to the side. In this way, if the access for dispensing wipes, such as dry wipes, is positioned on the bottom of the base shell, dispensing of fluid sanitizer can occur without interfering with or contaminating the wipes.

To initiate delivery of the fluid sanitizer, the upper assembly may further comprise a pump control which is configured to contact the pump of the dispenser when depressed. This control can be contacted by the user directly or, in a specific embodiment, a depressible section, such as a flexible rubber button, may be provided in the upper shell that is configured to engage the pump control. For example, the depressible section can be positioned at the top of the fluid sanitizer device, which, when depressed by a user, would contact the pump control to actuate pumping action and dispensing of fluid sanitizer. In this way, the pump control is not contacted directly, and the depressible section or button, which can be flush with the outer surface of the upper shell, can prevent foreign substances from entering the upper compartment and interfering with or damaging the pump or nozzle of the sanitizer disperser.

As discussed above, the fluid sanitizer device may also comprise a means to prevent delivery of sanitizer fluid by blocking actuation of the dispenser, thereby preventing accidental or inadvertent release and spills of the sanitizer. For example, the lower assembly may comprise at least one actuation block, particularly as part of the dispenser cradle supporting the fluid sanitizer dispenser. The pump control may be able to be positioned, such as by rotation of the upper assembly, particularly the upper shell relative to the base shell, to contact or otherwise engage the pump actuation block, preventing delivery of sanitizer. The pump control can further be positioned to avoid contact with the pump actuation block to allow hand sanitizer delivery.

Specific embodiments and components of the portable hand sanitizer device of the present disclosure are shown in FIGS. 1-9 and discussed below. However, it should be apparent to those skilled in the art that these are merely illustrative in nature and not limiting, being presented by way of example only. Numerous modifications and other embodiments are within the scope of ordinary skill in the art and are contemplated as falling within the scope of the present disclosure. In addition, those skilled in the art should appreciate that the specific configurations are exemplary and that actual configurations will depend on the specific system. Those skilled in the art will also be able to recognize and identify equivalents to the specific elements shown, using no more than routine experimentation.

An embodiment of the portable hand sanitizer device of the present disclosure is shown in FIG. 1, which is an exploded view showing the various components assembled to form the device 100. As shown, device 100 comprises upper assembly 100A and lower assembly 100B. Upper assembly 100A comprises upper shell 110 and means for dispensing fluid sanitizer, which, in the embodiment shown, is dispenser 120 which comprises pump 130 removably coupled to container 140. Pump control 190 is positioned over pump 130 to control dispensing of the fluid sanitizer. Lower assembly 100B comprises base shell 160 and a means for storing and dispensing dry wipes, which, in the embodiment shown, is a lower compartment formed and bounded by base shell 160 and dispenser cradle 150, which is a means for supporting dispenser 120 (i.e., container 140 coupled to pump 130). As shown, dispenser cradle 150 comprises a means for blocking actuation of the fluid sanitizer means, which, in this embodiment, is dispenser block 180 on an elongated wall section of the cradle, and fluid sanitizer dispenser 120 comprises a means for engaging the actuation blocking means, which, in this embodiment, is block contact 195 on pump control 190. In addition, base shell 160 further comprises access 170. Each of these is described in more detail below.

Figure 2A:
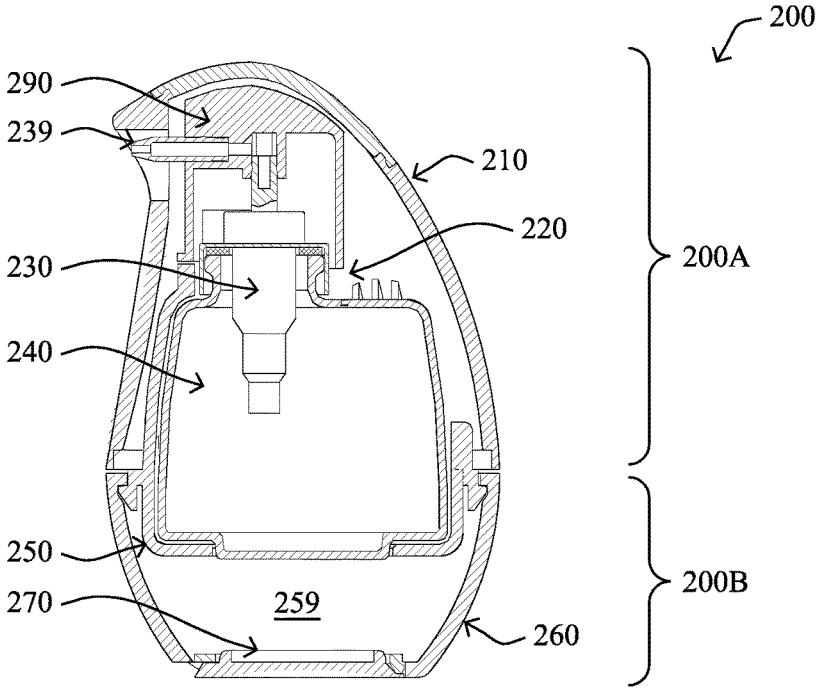
FIGS. 2A-2B are front and side assembled views of a specific embodiment of the portable hand sanitizer device of the present disclosure.
Figure 2B:
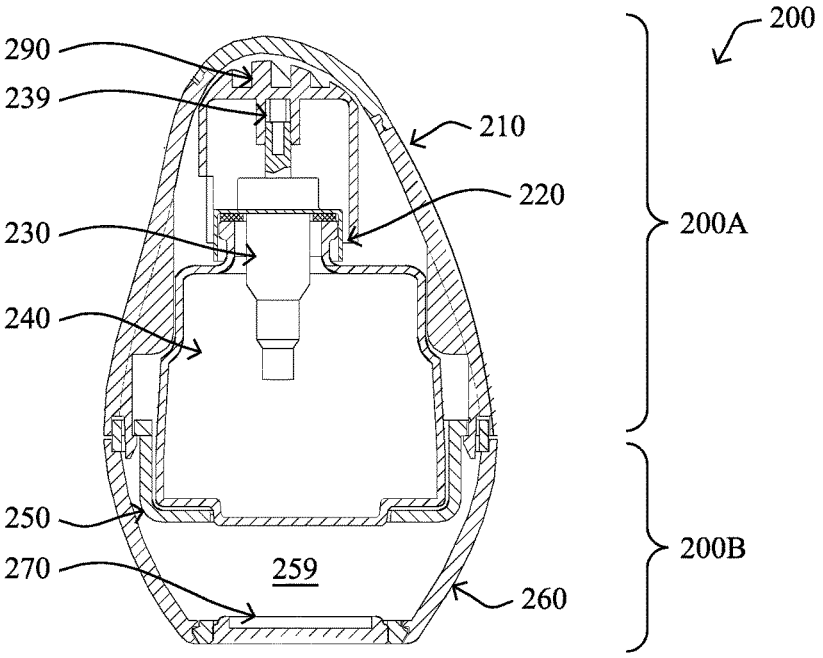

FIG. 2A, which is a schematic side view of a dispenser device 200, and FIG. 2B, which is a schematic front view of the device 200, such as the assembled form of device 100 shown in FIG. 1. As shown, device 200 comprises upper assembly 200A which is snapped together with or otherwise coupled to lower assembly 200B. Any means known in the art for attaching and detaching the assemblies can be used to couple assemblies 200A-200B, including, for example, clips or mated inserts. Lower assembly 200B comprises base shell 260 coupled to dispenser cradle 250, together forming lower compartment 259 in which dry wipes may be stored and from which they may be dispensed, such as through access 270. Upper assembly 200A comprises upper shell 210, coupled to the base shell, allowing for rotation of the upper shell relative to the base shell, and fluid sanitizer dispenser 220, which comprises pump 230 removably coupled to container 240, is positioned in or on dispenser cradle 250. Pump control 290 is positioned over fluid sanitizer dispenser 220 to control dispensing of the fluid sanitizer from the container through nozzle 239 when depressed.

Figure 3:
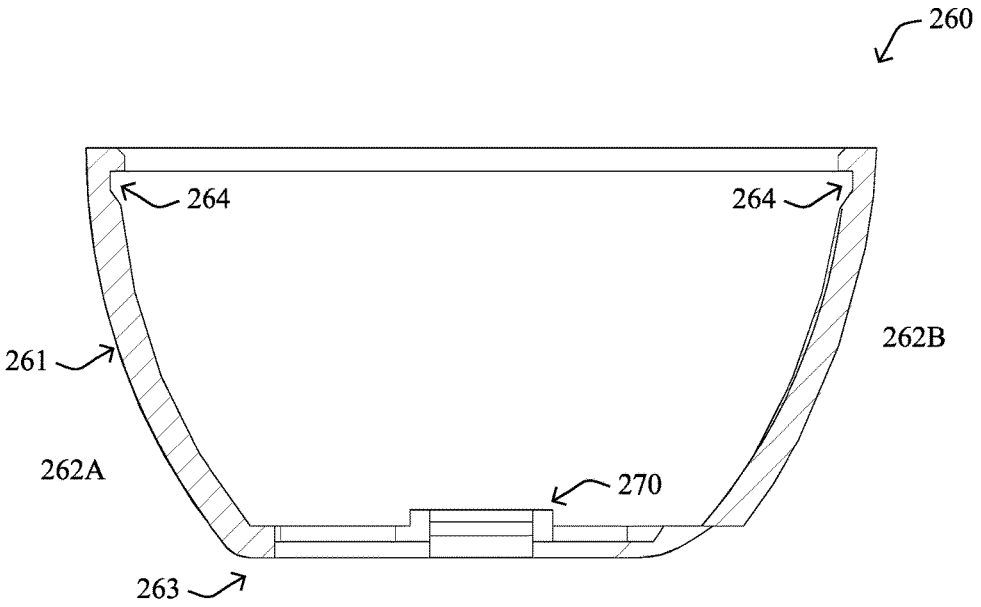
FIG. 3 is an example cross-sectional view of a base shell for a hand sanitizer device.
Figure 4:
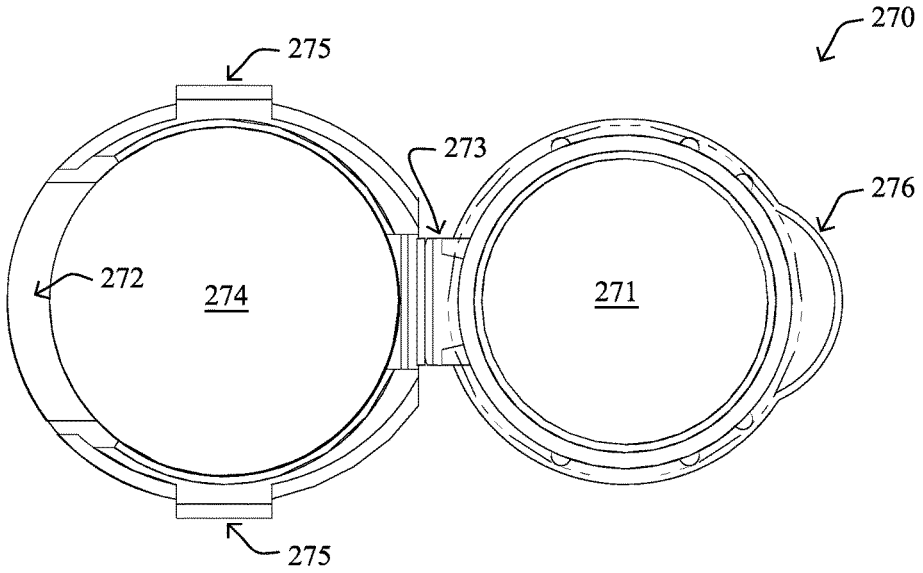
FIG. 4 is an example bottom view of the base shell of FIG. 3.

Base shell 260 is shown in more detail in FIG. 3. As shown, the base shell comprises outer wall 261, having curved outer contour 262A and 262B (which may be the same or different), giving the base a substantially spherical shape. In this embodiment, the walls comprise connectors 264, which may be one or a plurality of locations at the top of the base shell wall for connecting or otherwise coupling the base shell to the upper shell (e.g., an indent in the inner portion of base shell 260). The base shell further comprises bottom wall 263, which, as shown, may be substantially flat, allowing the device to sit upright. The bottom wall comprises access 270, which is shown in more detail in FIG. 4. As shown, access 270 comprises a hinged cover, with solid cap 271 connected to ring 272 by hinge 273, although these may also be separated pieces. Opening 274 of ring 272 is sized and shaped to allow dispensing of dry wipes contained in the lower compartment. Ring 274 comprises connectors 275 which secure the access to the bottom wall of the base shell. Cap 271 snaps or otherwise can be secured within opening 274 to seal the opening, with lip 276 allowing the users to open the cap when dry wipes are desired.

Figure 5:
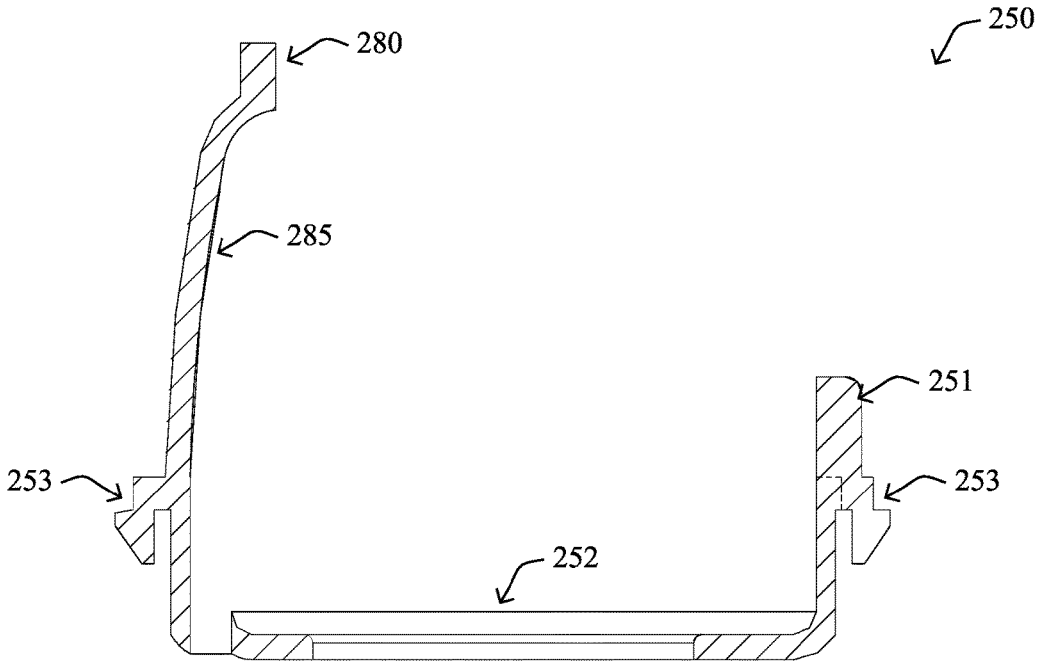
FIG. 5 is an example cross-sectional view of a dispenser cradle.
Figure 6:
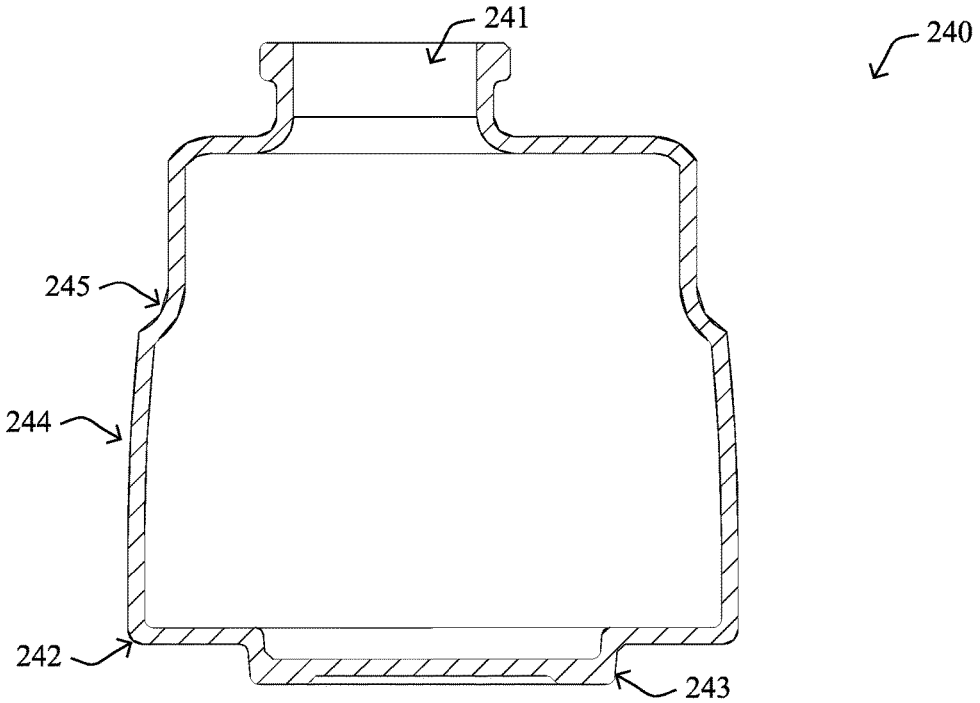
FIG. 6 is an example cross-sectional view of a sanitizer container.

Dispenser cradle 250 is shown in more detail in FIG. 5. As shown, the cradle comprises sidewall 251, having a generally circular cross-sectional shape, and bottom section 251 having an interior surface sized and shape to fit the container of the fluid sanitizer dispenser. Alternatively, or in addition, the bottom section may form an opening into which the container bottom can rest without falling through. In this embodiment, sidewall 251 further comprises one or more clips 253 which can be inserted into corresponding mating sections of the base shell (e.g., connectors 264), to form the lower compartment. Also as shown, dispenser cradle 250 further comprises a means for blocking actuation of the fluid sanitizer dispenser. In this embodiment, the dispenser cradle comprises elongated wall section 285, extending upward from sidewall 251, and further includes dispenser block 280. This is sized and shaped according to the design of the pump control, which, in this embodiment, comprises a block contact and is described and shown below.

As shown in FIGS. 2A and 2B, fluid sanitizer dispenser 220 comprises pump 230 removably coupled or connected to container 240 and further comprises pump control 290 positioned over the top of the pump. Pump 230 can be any pump known in the art capable of dispensing a fluid hand sanitizer, such as in a spray form or in fluid shots. Container 240 is shown in more detail in FIG. 6. As shown, the container comprises top opening 241 to which the pump of the fluid sanitizer dispenser may be removably attached and through which fluid sanitizer may be added. Container 240 further comprises bottom wall 242, which, as discussed above, has a shape consistent with bottom wall 252 of dispenser cradle 250. In the embodiment shown, the bottom wall comprises a protruding section 243, which allows the container to sit in a corresponding depression in the bottom of the cradle. The container further sidewalls 244 and, in one embodiment, has a generally circular cross-sectional shape. The container may be prepared with any material capable of withstanding contact with the fluid sanitizer without degrading or becoming damaged, especially alcohol based hand sanitizer, and would be known to one skilled in the art. Examples include polyolefins, such a polyethylene, and polyesters, such as PET. As shown, sidewalls 244 may also include one or more pockets 245, which may coincide with a stabilizer positioned on the inside of the upper shell, to hold container 240 in position without shifting and to rotate the container in the dispenser cradle.

Figure 7:
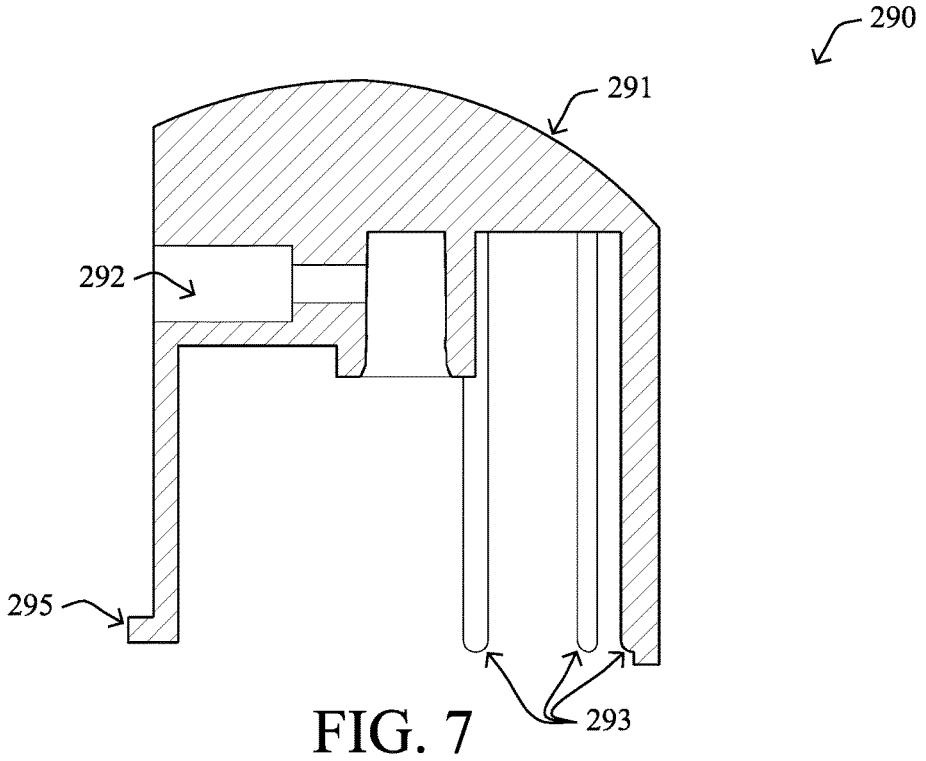
FIG. 7 is an example cross-sectional view of a pump control.
Figure 8:
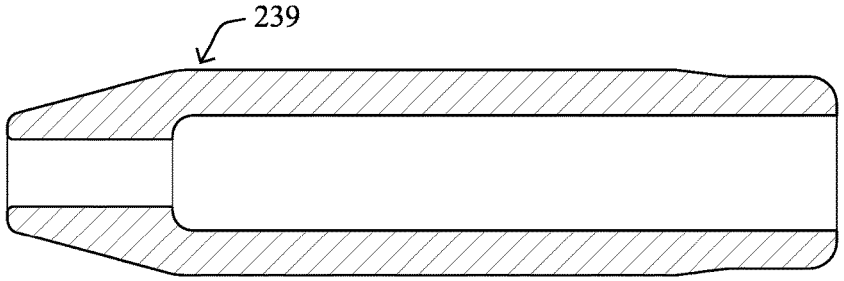
FIG. 8 is an example cross-sectional view of a pump nozzle.

Pump control 290 is shown in more detail in FIG. 7. As shown, pump control 290 comprise upper surface 291, which has an outer profile matching the profile of the inside of the upper shell. In this embodiment, pump control 290 further comprises nozzle opening 292 and pump top opening 293. Nozzle opening 292 is sized and shaped to accommodate nozzle 239, which is shown in more detail if FIG. 8. This opening is large enough so that the pump control can be rotated with the nozzle therein and attached to the pump of the dispenser. Pump top opening 293 is configured to allow insertion of the top of the pump and further allows the pump control to be rotated. In this embodiment, pump control 290 further comprises one or more stops 293, which prevents the pump control from being depressed excessively downward, such as by contacting with the top fluid sanitizer container.

A particular feature of this embodiment is that pump control further comprises a means for engaging the actuation blocking means, which, in this embodiment, is dispenser block 280 of dispenser cradle 250 shown in FIG. 5. As shown, pump control 290 comprises block contact 295. When the pump control is rotated and block contact 295 engages with dispenser block 280 when the pump is depressed, no fluid hand sanitizer is dispensed. When the pump is further rotated, block contact 295 may avoid contact with block dispenser 280, allowing hand sanitizer to be dispensed.

Figure 9:
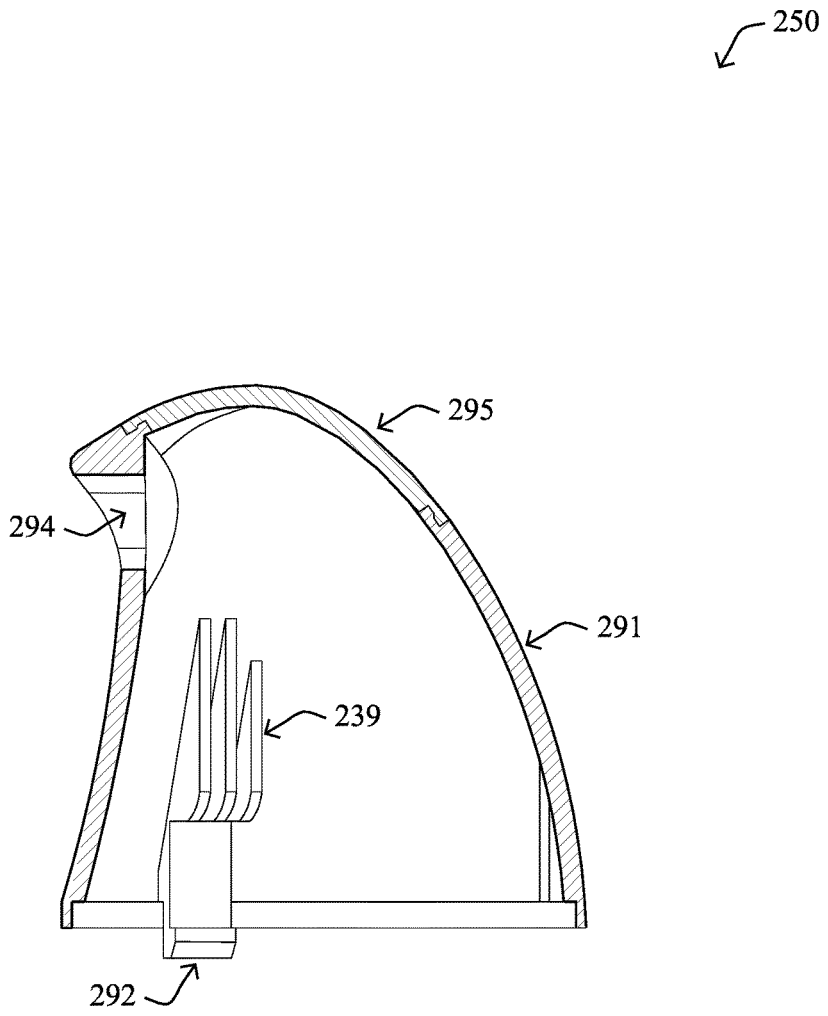
FIG. 9 is an example cross-sectional view of an upper shell for a hand sanitizer device.

The fluid sanitizer dispenser 220, comprising the pump and the container, as well as the pump control, each described above, is covered and protected by upper shell 210, which is shown in more detail in FIG. 9. As shown, has a generally rounded outer profile, and the ergonomic design allows the device to be comfortably held in a user's hand, particularly when dispensing fluid hand sanitizer. Thus, upper shell has curved outer surface 291 and, further, has at least one means for coupling or otherwise attaching to the base shell, such as one or more clips 292. As shown, upper shell 210 further comprises opening 294 in the side of shell through which the nozzle attached to the pump may protrude horizontally both when being depressed for sanitizer dispensing and when returning to the undepressed position. Given the general curvature of the upper shell, the position and shape of opening 294, and the position of the nozzle, the upper shell, in some embodiments, has the general shape of a bird, particularly when coupled with a generally spherical base shell.

In this embodiment, upper shell 210 further comprises stabilizers 293 which are configured to engage pockets 245 of the container. In this way, by rotating upper shell 210 90 degrees relative to the base shell, the fluid sanitizer dispenser 220 (including the container, the pump, and pump control) rotate relative to the cradle on which the container rests (which may further include tracks to enable movement). Since the cradle is stationary, dispenser block 280 may be disengaged from block contact 295, allowing the pump to dispense fluid sanitizer. Rotation by 90 degrees back in the opposite direction would reengage the block contact and the dispenser block, preventing dispensing of sanitizer. Suitable markers or locks may be included, such as along the outsides of the upper and/or base shells to indicate the position of engagement.

Upper shell 290, in a specific embodiment, further comprises depressible portion 296, which is a separable cap or covering configured to engage the pump control positioned over the fluid sanitizer dispenser. For example, depressible portion 296 may be a section of the upper shell and flush with the contour of the shell, but prepared using a flexible rubbery material such as, for example, a thermoplastic elastomer, as opposed to the more rigid material of the shell, which may be, for example, a polyolefin such a polypropylene. In this way, the dispenser may be depressed from outside the device, with the contents and components within safe from dirt or damage.

Thus, the present disclosure also relates to a method of dispensing fluid sanitizer and dry wipes from a single portable device. For example, the method may comprise providing a portable hand sanitizer device as described above, having an upper shell and base shell, filling a container with fluid sanitizer and positioning the filled container in the upper shell of the device, and filling a lower compartment of the base shell with dry wipes. The method further comprises rotating a pump control positioned over a pump inserted into the filled container, such as by rotating the upper shell relative to the base shell, so that the pump control does not engage a pump actuation block that prevents dispensing of fluid sanitizer. Once positioned, the method further comprises dispensing fluid sanitizer by depressing the pump control to contact the pump inserted into the fluid sanitizer and removing at least one dry wipe from the filled lower compartment through the access in the base shell. Other variations of use of the portable hand sanitizer device described above will be known to one skilled in the art, given the benefit of this disclosure.

The foregoing description of preferred embodiments of the present disclosure has been presented for the purposes of illustration and description. It is not intended to be exhaustive or to limit the disclosure to the precise form disclosed. Modifications and variations are possible in light of the above teachings, or may be acquired from practice of the disclosure. The embodiments were chosen and described in order to explain the underlying principles and their practical application to enable one skilled in the art to utilize the disclosure in various embodiments and with various modifications as are suited to the particular use contemplated. It is intended that the scope of the disclosure be defined by the claims appended hereto and their equivalents.

What is claimed is:

1. A portable hand sanitizer device having an upper assembly and a lower assembly, wherein the lower assembly comprises:

a base shell;

a dispenser cradle coupled to the base shell forming a lower compartment configured for storing dry wipes;

at least one pump actuation block; and at least one access configured for dispensing the dry wipes, and wherein the upper assembly comprises:

an upper shell coupled to the base shell, a fluid sanitizer dispenser positioned on the dispensing cradle and within the upper shell, the dispenser comprising a pump for dispensing fluid sanitizer when depressed, the pump removably coupled to a container; and a pump control contactable with the pump when depressed and rotatable to engage the pump actuation block.

2. The portable hand sanitizer device of claim 1, wherein the dispenser cradle comprises the pump actuation block.

3. The portable hand sanitizer device of claim 1, wherein the pump control is further rotatable to not engage the pump actuation block.

4. The portable hand sanitizer device of claim 1, wherein the access of the base shell further comprises a removable cover.

5. The portable hand sanitizer device of claim 1, wherein the access of the base shell further comprises a hinged cover.

6. The portable hand sanitizer device of claim 1, wherein the upper shell further comprises an opening configured for dispensing a fluid sanitizer therethrough.

7. The portable hand sanitizer device of claim 6, wherein the fluid sanitizer dispenser further comprises a nozzle coupled to the pump and positioned to protrude through the opening in the upper shell.

8. The portable hand sanitizer device of claim 7, wherein the opening is in a side of the upper shell and the nozzle protrudes through the opening substantially perpendicular to the side.

9. The portable hand sanitizer device of claim 7, wherein the opening is sized and shaped to for the nozzle when the pump control is depressed and released.

10. The portable hand sanitizer device of claim 1, wherein the upper shell further comprises a depressible portion configured to engage the pump control.

11. The portable hand sanitizer device of claim 10, wherein the depressible portion is at a top of the upper shell.

12. The portable hand sanitizer device of claim 1, wherein the pump control, when depressed, engages and depresses the pump to dispense fluid sanitizer and, when released, disengages with the pump actuator to end dispensing.

13. The portable hand sanitizer device of claim 1, wherein the upper shell has a rounded outer profile configured to conform to a user's hand when depressing the pump control.

14. The portable hand sanitizer device of claim 1, wherein the base shell has a substantially spherical shape configured to conform to a user's hand when held.

15. The portable hand sanitizer device of claim 14, wherein the base shell has a flat bottom portion configured to enable the portable hand sanitizer device to stand upright.

16. The portable hand sanitizer device of claim 15, wherein the flat bottom portion comprises the access of the base shell.

17. A portable hand sanitizer device having an upper assembly and a lower assembly, wherein the lower assembly comprises:

a base shell;

means for storing and dispensing dry wipes; and means for blocking actuation of a fluid sanitizer dispensing means;

and wherein the upper assembly comprises:

an upper shell coupled to the base shell, the means for dispensing fluid sanitizer; and a means for engaging the actuation blocking means.

18. The portable hand sanitizer device of claim 17, wherein the lower assembly further comprises a means for supporting the fluid sanitizer dispensing means.

19. The portable hand sanitizer device of claim 18, wherein the means for supporting the fluid sanitizer dispensing means comprises the means for blocking actuation.

20. A method of dispensing fluid sanitizer and dry wipes comprising i) providing a portable hand sanitizer device having an upper assembly and a lower assembly, wherein the lower assembly comprises:

a base shell;

a dispenser cradle coupled to the base shell forming a lower compartment configured for storing dry wipes;

at least one pump actuation block; and at least one access configured for dispensing the dry wipes, and wherein the upper assembly comprises:

an upper shell coupled to the base shell, a fluid sanitizer dispenser positioned on the dispensing cradle and within the upper shell, the dispenser comprising a pump for dispensing fluid sanitizer when depressed, the pump removably coupled to a container; and a pump control contactable with the pump when depressed and rotatable to engage the pump actuation block;

ii) filling the container with fluid sanitizer and the lower compartment with dry wipes;

iii) rotating the pump control to not engage the pump actuation block;

iv) dispensing fluid sanitizer by depressing the pump control to contact the pump inserted into the fluid sanitizer; and v) removing at least one dry wipe through the access in the base shell.

* * * * *